US007636229B2

(12) United States Patent
Kato et al.

(10) Patent No.: US 7,636,229 B2
(45) Date of Patent: Dec. 22, 2009

(54) ION GENERATING UNIT AND ION GENERATING APPARATUS

(75) Inventors: Shinji Kato, Mishima-gun (JP); Yukihiko Yoshida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 485 days.

(21) Appl. No.: 11/566,273

(22) Filed: Dec. 4, 2006

(65) Prior Publication Data

US 2007/0091536 A1 Apr. 26, 2007

Related U.S. Application Data

(63) Continuation of application No. PCT/JP2005/019317, filed on Oct. 20, 2005.

(30) Foreign Application Priority Data

Dec. 28, 2004 (JP) ..... 2004-382063
Jul. 26, 2005 (JP) ..... 2005-215332

(51) Int. Cl.
*H01T 23/00* (2006.01)

(52) U.S. Cl. ..... 361/230

(58) Field of Classification Search ..... 361/230, 361/225, 231, 229
See application file for complete search history.

(56) References Cited

U.S. PATENT DOCUMENTS 3,418,501 A * 12/1968 Felici et al. ..... 310/309
3,761,746 A * 9/1973 Adler ..... 310/311
4,417,293 A 11/1983 Larigaldie
4,673,416 A 6/1987 Sakakibara et al.
4,686,370 A * 8/1987 Blach ..... 250/423 R
4,975,579 A * 12/1990 Iwanaga ..... 250/324
5,049,669 A * 9/1991 Garret et al. ..... 514/226.2
5,079,669 A 1/1992 Williams (Continued)

FOREIGN PATENT DOCUMENTS

EP 0373869 A2 6/1990

(Continued)

OTHER PUBLICATIONS

Official communication issued in the corresponding International Application No. PCT/JP2005/019317, mailed on Jan. 24, 2006.

(Continued)

*Primary Examiner*—Stephen W Jackson
*Assistant Examiner*—Angela Brooks
(74) *Attorney, Agent, or Firm*—Keating & Bennett, LLP

(57) ABSTRACT

An ion generating component includes, on an insulating substrate, a ground electrode, a high-voltage electrode, an insulating film on the surface of the ground electrode, and a linear electrode. The ground electrode is disposed at the outer region of the insulating substrate and includes a pair of legs, which are substantially parallel to the linear electrode, which is disposed between the legs. The ground electrode further includes a contact portion in contact with a terminal and an insulating casing contact portion in contact with the upper resin casing. The insulating film is disposed on substantially the entire surface of the insulating substrate so that the high-voltage electrode, the contact portion, and the insulating casing contact portion of the ground electrode remain uncovered.

14 Claims, 6 Drawing Sheets

U.S. PATENT DOCUMENTS

| | | | | |
|---|---|---|---|---|
| 5,114,677 | A | 5/1992 | Steele et al. | |
| 5,377,070 | A * | 12/1994 | Kawamoto | 361/229 |
| 6,040,055 | A * | 3/2000 | Baba et al. | 428/428 |
| 2002/0048818 | A1 * | 4/2002 | Sakairi et al. | 436/126 |
| 2005/0036266 | A1 | 2/2005 | Kato et al. | |

FOREIGN PATENT DOCUMENTS

| | | | |
|---|---|---|---|
| EP | 0525193 | A2 | 2/1993 |
| JP | 06-181087 | A | 6/1994 |
| JP | 10-261477 | A | 9/1998 |
| JP | 11-191478 | A | 7/1999 |
| JP | 2005-063827 | A | 3/2005 |

OTHER PUBLICATIONS

Official Communication dated Dec. 7, 2005, issued in the European Patent Application No. 04 012 775.5-2301.

Official Communication dated Oct. 21, 2005, issued in the corresponding Korean Patent Application No. 10-2004-0055976.

Non-Final Office Action dated Jan. 9, 2006, issued in U.S. Appl. No. 10/851,568 ( U.S. 2005/0036266).

Final Office Action dated Jul. 10, 2006, issued in U.S. Appl. No. 10/851,568 ( U.S. 2005/0036266).

* cited by examiner

PRIORT ART

ION GENERATING UNIT AND ION GENERATING APPARATUS

BACKGROUND OF THE INVENTION

1. Field of the Invention

The present invention relates to an ion generating unit and an ion generating apparatus for use in an ion generating circuit in, for example, an air cleaner or an air conditioner.

2. Description of the Related Art

One known ion generating apparatus of this kind is described in Japanese Unexamined Patent Application Publication No. 6-181087 (Patent Document 1). As illustrated in FIG. 12, an ion generating apparatus 110 includes a housing 120, a discharge electrode 112 mounted to the front surface of the housing 120, and an opposing electrode 114. A high-voltage power supply portion 118 is disposed on the top of the housing 120. The high-voltage power supply portion 118 incorporates a high-voltage generating circuit for applying an alternating-current high voltage between the discharge electrode 112 and the opposing electrode 114.

The discharge electrode 112 includes a plurality of sawteeth 112*a*. The discharge electrode 112 and the opposing electrode 114 are perpendicular to each other. The opposing electrode 114 is fixed to a seat portion 120*b* of the housing 120. The opposing electrode 114 has a structure in which a metal is embedded in a dielectric ceramic material. The discharge electrode 112 and the opposing electrode 114 generate ozone by discharge and convert air into negative ions by using an applied alternating voltage.

However, it is necessary for the known ion generating apparatus 110 to apply a high voltage of −5 kV to −7 kV to the discharge electrode 112 in order to generate negative ions. This requires a complicated power-supply circuit and insulation structure, so that a problem of the high cost of manufacturing the ion generating apparatus 110 arises.

When a high voltage of −5 kV to −7 kV is applied to the discharge electrode 112, ozone is produced concomitantly. Therefore, it is impossible to selectively generate only negative ions. In addition, it is necessary to take sufficient safety measures against the high voltage applied to the discharge electrode 112.

Furthermore, because the discharge electrode 112 and the opposing electrode 114 perpendicularly face each other (i.e., have a three-dimensional structure), the occupied volume is relatively large, and thus, miniaturization of the ion generating apparatus 110 is difficult.

SUMMARY OF THE INVENTION

To overcome the problems described above, preferred embodiments of the present invention provide an ion generating unit and an ion generating apparatus that can generate negative ions or positive ions through the application of a low voltage.

An ion generating unit according to a preferred embodiment of the present invention includes an insulating substrate provided with a ground electrode, the insulating substrate being provided with an insulating film at a region except for a portion of the ground electrode so as to cover the ground electrode, a linear electrode, and an insulating casing for accommodating the insulating substrate and the linear electrode, wherein the linear electrode is mounted to the insulating substrate so that the linear electrode faces the ground electrode, and the portion of the ground electrode that is not covered by the insulating film is connected to the insulating casing.

Preferably, in the ion generating unit according to this preferred embodiment of the present invention, a high-voltage electrode having a contact portion is provided on the insulating substrate, the linear electrode is mounted to the high-voltage electrode, and the insulating film is disposed so as to cover substantially the entire surface of the insulating substrate so that the high-voltage electrode, a contact portion and an insulating casing contact portion of the ground electrode remain uncovered.

By using the linear electrode (preferably having a diameter of about 100 μm or less), electrons readily concentrate on the end of the linear electrode, and a strong electric field occurs. Preferably, the linear electrode has a tensile strength of at least about 2500 N/mm$^2$. In addition, connecting the portion of the ground electrode that is not covered by the insulating film and the insulating substrate together reduces the ion charge of the insulating casing and prevents a decrease in electric field strength of the ion generating portion caused by the ion charge of the insulating casing.

Covering the surface of the ground electrode with the insulating film suppresses generation of ozone without substantially changing the amount of generated ions. In addition, by providing the insulating film so as to cover substantially the entire surface of the insulating substrate so that the high-voltage electrode and the contact portion and the insulating casing contact portion of the ground electrode remain uncovered, the gap between the high-voltage electrode and the ground electrode is covered with the insulating film, such that a short caused by condensation between the high-voltage electrode and the ground electrode is prevented.

In the ion generating unit according to preferred embodiments of the present invention, preferably, the ground electrode is preferably arranged so as to be substantially parallel to the longitudinal direction of the linear electrode. More specifically, a side of the insulating substrate preferably includes a depression, an end of the linear electrode projects in the depression, and the ground electrode has two legs extending substantially parallel to the linear electrode and disposed on the insulating substrate so that the two legs are disposed on both sides of the depression and so that the linear electrode is disposed between the two legs.

The insulating casing preferably may include an upper casing and a lower casing. Preferably, the lower casing is provided with a protrusion substantially corresponding to the insulating casing contact portion of the ground electrode on the insulating substrate. Alternatively, the upper casing may be provided with a projection corresponding to the insulating casing contact portion of the ground electrode on the insulating substrate. By pressing the protrusion of the lower casing against the insulating substrate and/or causing the projection to come into contact with the insulating casing contact portion, reliability of contact between the insulating casing and the insulating casing contact portion of the ground electrode is improved.

The above-described structure enables the linear electrode and the ground electrode to be constructed two-dimensionally, so that the thickness of the ion generating component is reduced.

The ground electrode includes a resistor, for example, a ruthenium oxide resistor or a carbon resistor. This is because, even if the linear electrode comes into contact with the ground electrode, the resistor reduces the risk of an occurrence of heating or igniting caused by a short. In particular, ruthenium oxide is an optimum material because it does not cause migration even if a high electric field is applied thereto.

The ion generating unit preferably further includes a first terminal in contact with and connected to the contact portion of the high-voltage electrode and having a retaining portion for a lead and a second terminal being in contact with and connected to the contact portion of the ground electrode and having a retaining portion for a lead, wherein the first terminal and the second terminal are accommodated in the insulating casing.

An ion generating apparatus according to another preferred embodiment of the present invention includes the ion generating unit described above and a high-voltage power supply for generating a negative voltage or a positive voltage. Alternatively, an ion generating apparatus according to another preferred embodiment of the present invention includes a lead retained by each of the first terminal and the second terminal, a high-voltage power supply for generating a negative voltage or a positive voltage, and the ion generating unit described above. Preferably, the absolute value of an output voltage from the high-voltage power supply may be equal to or less than about 2.5 kV.

According to the above-described structure, a small ion generating apparatus with a reduced cost is obtained.

Since the ion generating unit according to preferred embodiments of the present invention uses a thin linear electrode, electrons readily concentrate on the end of the linear electrode, and a strong electric field readily occurs. Therefore, negative ions or positive ions can be generated through the application of a lower voltage as compared to the related art. In addition, connecting the portion which is not covered by the insulating film of the ground electrode and the insulating casing together reduces ion charge of the insulating casing and prevents a decrease in electric field strength of the ion generating portion caused by the ion charge of the insulating casing.

Covering the surface of the ground electrode with the insulating film suppresses generation of ozone without substantially changing the amount of generated ions. In addition, by providing the insulating film so as to cover substantially the entire surface of the insulating substrate so that the high-voltage electrode, the contact portion and the insulating casing contact portion of the ground electrode remain uncovered, the gap between the high-voltage electrode and the ground electrode is covered with the insulating film, so that a short caused by condensation between the high-voltage electrode and the ground electrode is prevented. As a result, a small ion generating unit and ion generating apparatus with a reduced cost is obtained.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

An ion generating unit and an ion generating apparatus according to preferred embodiments of the present invention are described below with reference to the drawings.

Figure 1:
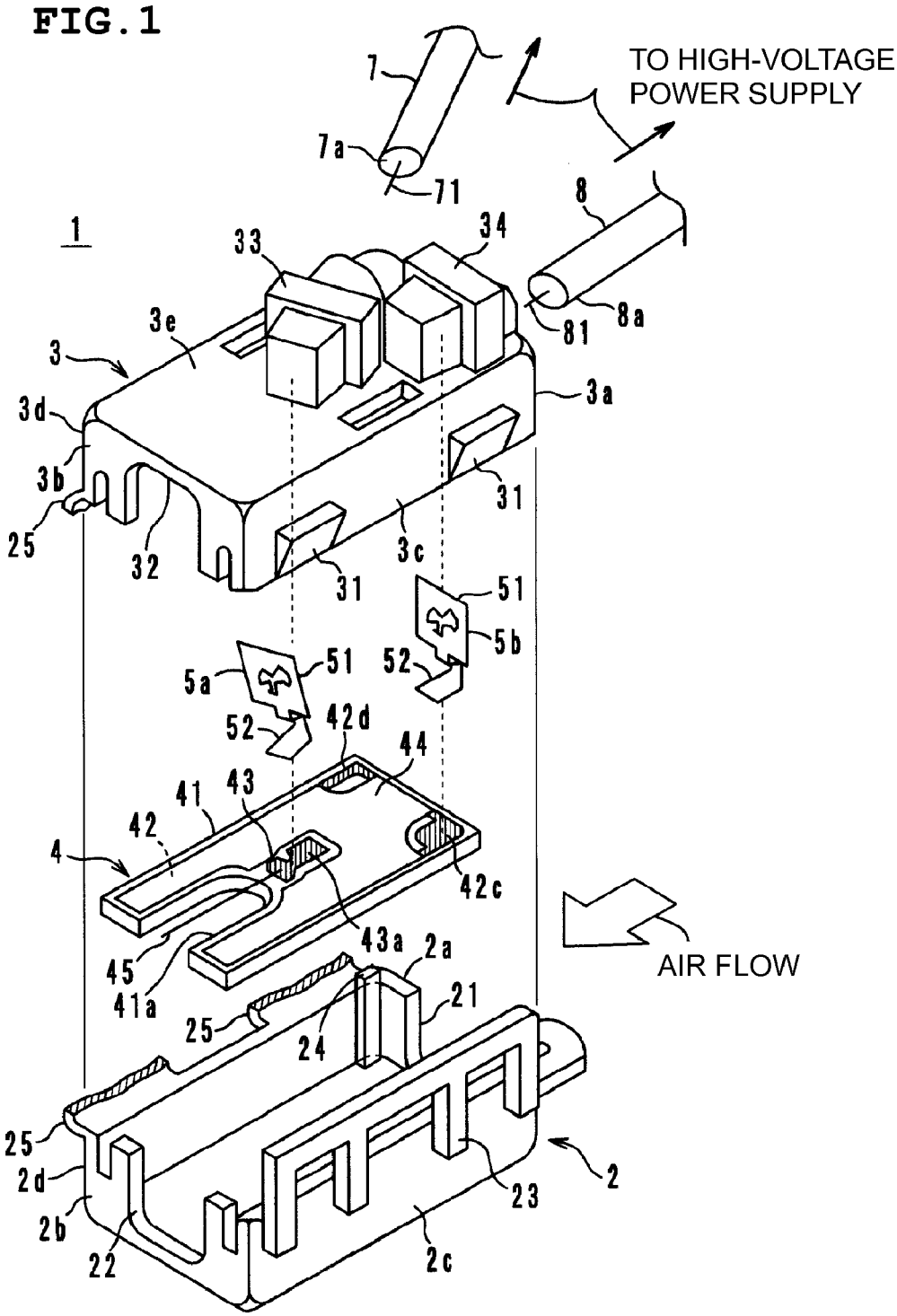
FIG. 1 is an exploded perspective view of an ion generating apparatus according to a preferred embodiment of the present invention.
Figure 2:
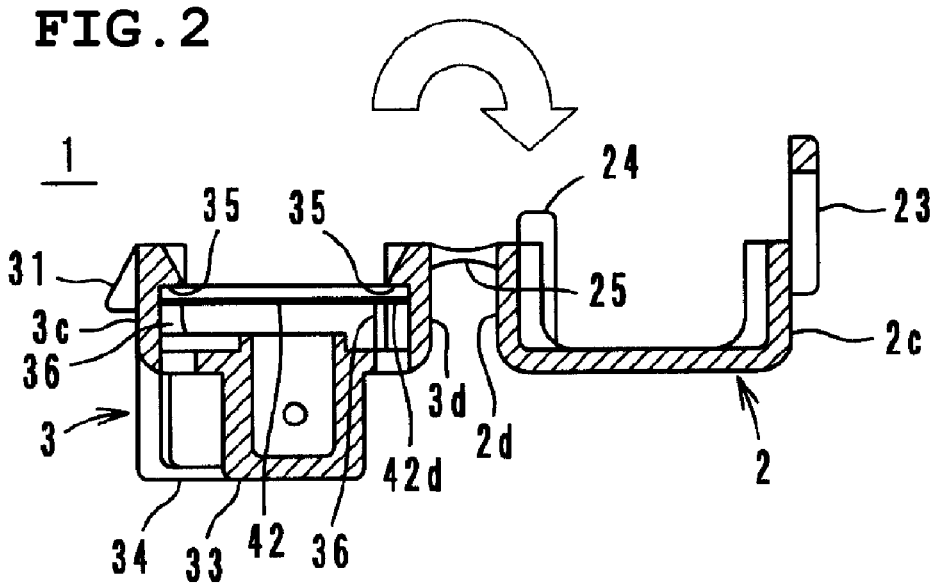
FIG. 2 is a cross-sectional view of the ion generating apparatus shown in FIG. 1.
Figure 3:
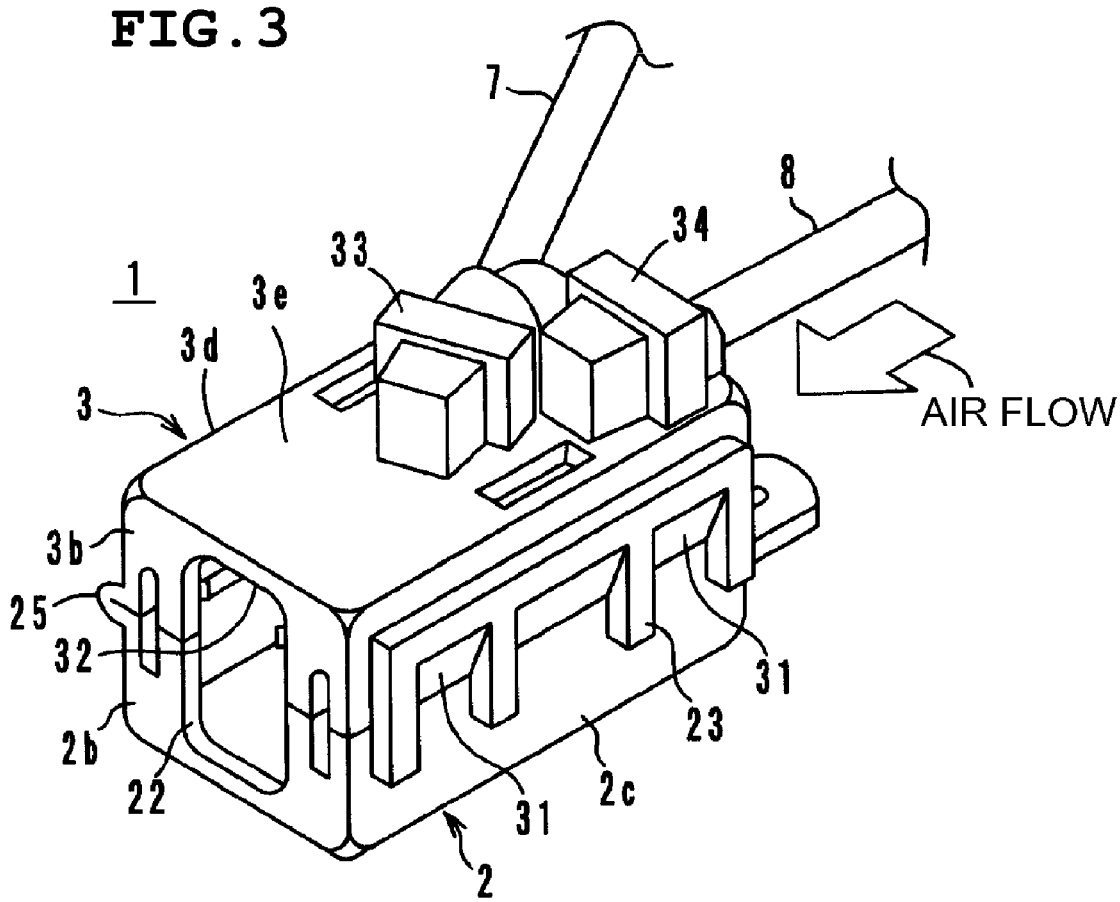
FIG. 3 is an external perspective view of the ion generating apparatus shown in FIG. 1.

FIG. 1 is an exploded perspective view of an ion generating apparatus 1, FIG. 2 is a cross-sectional view thereof, and FIG. 3 is an external perspective view thereof. As illustrated in FIG. 1, the ion generating apparatus 1 includes an insulating casing in which a lower resin casing 2 and an upper resin casing 3 are integral with each other with a hinge 25 therebetween, an ion generating component 4, a first terminal 5*a*, a second terminal 5*b*, leads 7 and 8, and a high-voltage power supply. The insulating casing including the lower resin casing 2 and the upper resin casing 3, the ion generating component 4, the first terminal 5*a*, and the second terminal 5*b* defines an ion generating unit. In FIG. 1, the hinge 25 is illustrated in a vertically cut state.

The lower resin casing 2 is provided with an air intake 21 in a side wall 2*a* at a first end and provided with an air outlet 22 in a side wall 2*b* at a second end. In addition, a front side wall 2*c* is provided with a retaining arm 23.

The upper resin casing 3 is provided with an air intake (not shown) in a side wall 3*a* at a first end and provided with an air outlet 32 in a side wall 3*b* at a second end. A front side wall 3*c* is provided with two claws 31. The hinge 25 includes a first end joined to a side wall 2*d* at the back of the lower resin casing 2 and includes a second end joined to a side wall 3*d* at the back of the upper resin casing 3. Bending the hinge 25 and fitting the claws 31 into the retaining arm 23 securely joins the upper resin casing 3 and the lower resin casing 2 together and forms the air-permeable insulating casing.

The ion generating component 4 and the terminals 5*a* and 5*b* are disposed in a storage portion inside the upper resin casing 3 and the lower resin casing 2. That is, as illustrated in FIG. 2, the ion generating component 4 is disposed between a substrate receiving base 36 and a claw 35. Examples of a material of the insulating casing include PBT resin, PC resin, and other suitable materials, which are injection moldable and allow a hinge to be provided.

Figure 4:
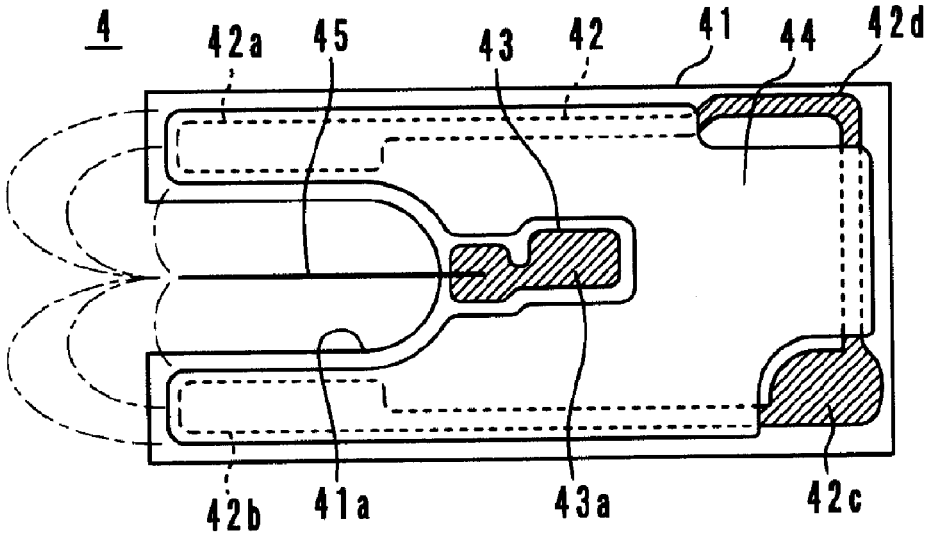
FIG. 4 is a plan view of an ion generating component shown in FIG. 1.

As illustrated in FIG. 4, the ion generating component 4 includes, on an insulating substrate 41, a ground electrode 42 and a high-voltage electrode 43, an insulating film 44 on the surface of the ground electrode 42, and a linear electrode 45. The substantially rectangular insulating substrate 41 is provided with a depression 41*a*, which is cut in one side thereof. Examples of the insulating substrate 41 include an alumina substrate and a glass epoxy substrate having dimensions of about 10.0 mm wide×20.0 mm long×0.635 mm thick. A base of the linear electrode 45 is soldered to the high-voltage electrode 43, and an end of the linear electrode 45 projects into the depression 41*a*. An example of the linear electrode 45 is an extra-fine line having a diameter of about 100 μm or less. Examples of the line include piano wire, tungsten wire, stainless steel wire, and titanium wire. A diameter of about 100 μm or less enables electrons to concentrate on the end of the linear electrode 45, thus facilitating the occurrence of a strong electric field.

Preferably, the linear electrode 45 includes stainless wire having a tensile strength of at least about 2500 N/mm$^2$. A tensile strength of at least about 2500 N/mm$^2$ can be obtained by the composition ratio of a line material and/or heat treatment after wiredrawing. By use of the linear electrode 45 having a tensile strength of at least about 2500 N/mm$^2$, the linear electrode 45 is resistant to bending, exhibits high restoration even when external forces are applied, and is prevented from being displaced from a predetermined position.

The ground electrode 42 is disposed at the outer region of the insulating substrate 41 and includes a pair of legs 42*a* and 42*b* arranged substantially parallel to the linear electrode 45, which is disposed between the legs 42*a* and 42*b*, on the insulating substrate 41 at opposite sides of the depression 41*a*. The ground electrode 42 further includes a contact portion 42*c* in contact with the second terminal 5*b* and an insulating casing contact portion 42*d* in contact with the substrate receiving base 36 of the upper resin casing 3. The insulating casing contact portion 42*d* is spaced from the legs 42*a* and 42*b* (high-voltage discharge portion) and is also distant from the linear electrode 45 and the high-voltage electrode 43. The distance from the linear electrode 45 and the high-voltage electrode 43 to the ground electrode 42 is maintained as great as possible to ensure withstand voltage therebetween. The insulating casing contact portion 42*d* is arranged so as to be adjacent to the periphery of the insulating substrate 41 in order to achieve reliable contact using the insulating substrate 41 of minimum size.

Figure 5:
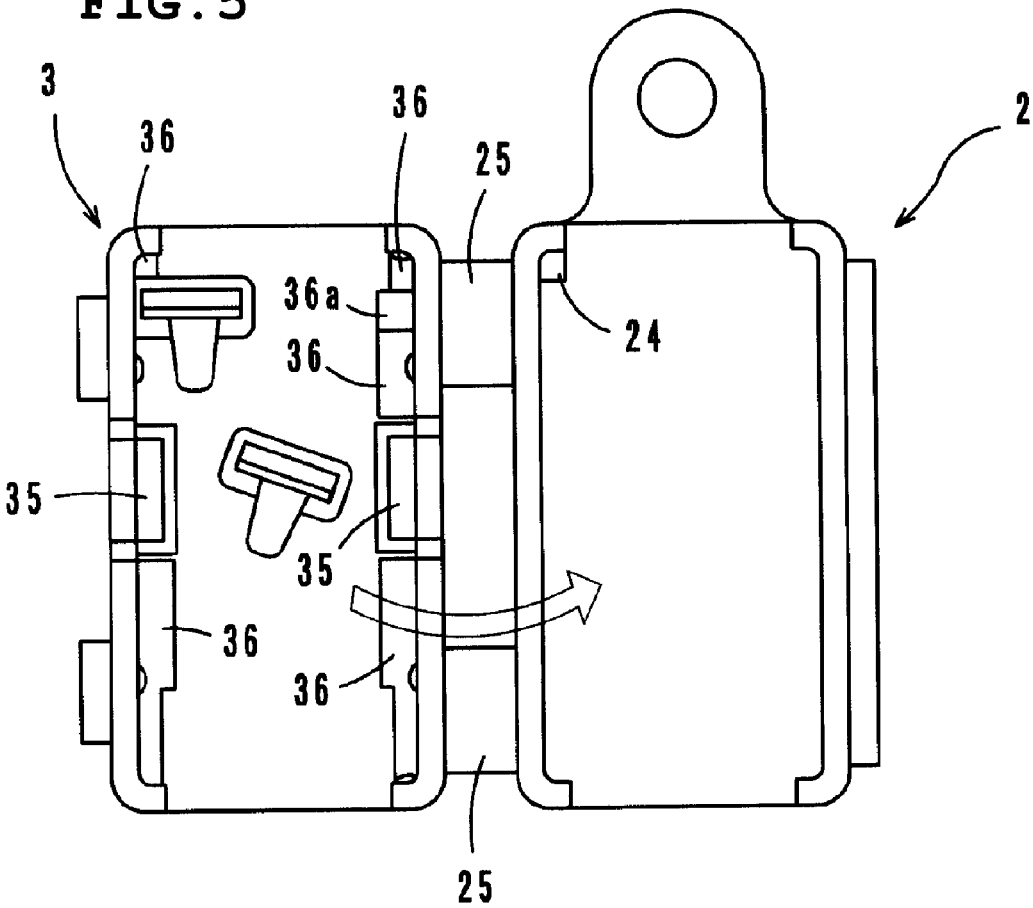
FIG. 5 is a developed view of an insulating casing included in the ion generating component.
Figure 6:
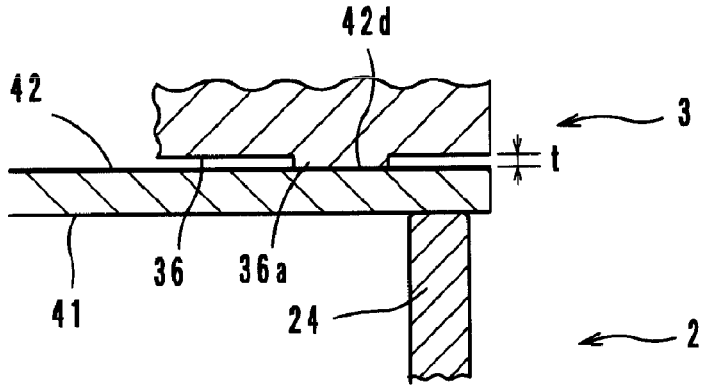
FIG. 6 is a cross-sectional view showing an enlarged main part of the insulating casing in an assembled state.

As illustrated in FIGS. 5 and 6, the substrate receiving base 36, which is in contact with the insulating casing contact portion 42*d* of the ground electrode 42, is provided with a projection 36*a* at a position corresponding to the insulating casing contact portion 42*d*. In addition, the lower resin casing 2 is provided with a protrusion 24 at a position that substantially faces the projection 36*a*. When the insulating casing is assembled, the protrusion 24 presses the insulating substrate 41, and the projection 36*a* is pressed into contact with the insulating casing contact portion 42*d*. The height of the projection 36*a*, t, (see FIG. 6) is about 0.1 mm in this preferred embodiment. The projection 36*a* is pressed into contact with the insulating casing contact portion 42*d*, thus improving reliability of contact between the insulating casing and the insulating casing contact portion 42*d* of the ground electrode 42. In particular, by the pressing of the protrusion 24 on the lower resin casing 2 against the insulating substrate 41 at a position that substantially faces the projection 36*a*, the reliability of contact between the insulating casing and the insulating casing contact portion 42*d* is further improved.

Only either one of the protrusion 24 and the projection 36*a* may be provided. The provision of only the protrusion 24 increases the reliability of contact between the insulating casing contact portion 42*d* and the insulating casing. The provision of only the projection 36*a* also increases the reliability of contact between the insulating casing contact portion 42*d* and the insulating casing.

Figure 11:
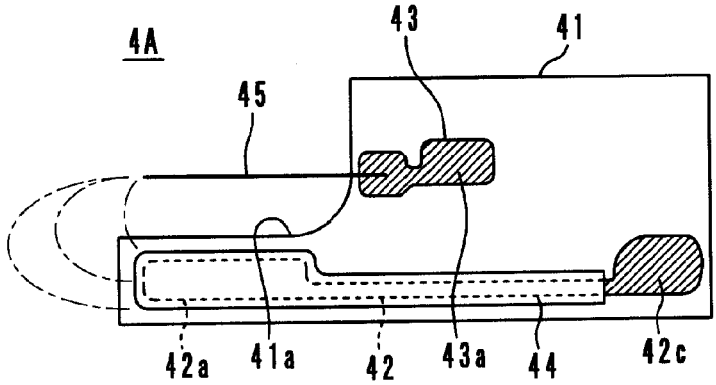
FIG. 11 is a plan view of an ion generating component according to another preferred embodiment of the present invention.

As in another preferred embodiment illustrated in FIG. 11, the contact portion 42*c* may also function as a contact portion to the upper resin casing 3. In this case, the insulating casing contact portion 42*d* may not be provided.

The insulating film 44 is provided preferably by screen printing on substantially the entire surface of the insulating substrate 41 so that the high-voltage electrode 43, the contact portion 42*c*, and the insulating casing contact portion 42*d* of the ground electrode 42 remain uncovered. The insulating film 44 is not provided on the outer regions of the insulating substrate 41 so as to accommodate misalignment in screen printing.

Examples of a material of the insulating film 44 include silicone resin, glass glaze, and epoxy resin. The ground electrode 42 has a resistance of about 50 MΩ. Examples of a material of the ground electrode 42 include ruthenium oxide paste or carbon paste. In particular, ruthenium oxide is an optimum material because it does not cause migration if a high electric field is applied thereto.

Each of the metal terminals 5*a* and 5*b* includes a retaining portion 51 and a foot portion 52. The retaining portions 51 are fit into holding portions 33 and 34 on an upper surface 3*e* of the upper resin casing 3. The foot portion 52 of the first terminal 5*a* is in contact with and connected to a contact portion 43*a* of the high-voltage electrode 43. The foot portion 52 of the second terminal 5*b* is in contact with and connected to the contact portion 42*c* of the ground electrode 42.

An end 7*a* of the high-voltage lead 7 is fit into an opening (not shown) disposed at the front surface of the holding portion 33 of the upper resin casing 3, and a conductor 71 engages with the retaining portion 51 of the first terminal 5*a* and is electrically connected thereto. Similarly, an end 8*a* of the ground lead 8 is fit into an opening (not shown) disposed at the front surface of the holding portion 34, and a conductor 81 engages with the retaining portion 51 of the first terminal 5*b* and is electrically connected thereto.

The high-voltage lead 7 is connected to a negative output terminal of the high-voltage power supply. The ground lead 8 is connected to a ground output terminal of the high-voltage power supply. The high-voltage power supply supplies a negative direct-current voltage and may supply an alternating voltage on which a negative direct-current bias is superimposed. The ion generating apparatus 1 is incorporated in an air cleaner, an air conditioner, or other suitable device. In other words, the high-voltage power supply is mounted in a power supply circuit portion of the air cleaner, and the ion generating unit is mounted in an air supply path, so that the air cleaner sends air containing negative ions.

The ion generating apparatus 1 having the above-described structure can generate negative ions with a voltage of about −1.3 kV to about −2.5 kV. In other words, when a negative voltage is applied to the linear electrode 45, a strong electric field is formed between the linear electrode 45 and the ground electrode 42. The end of the linear electrode 45 is subjected to dielectric breakdown and is brought in a corona discharge state. At this time, around the end of the linear electrode 45, molecules in the air are brought into a plasma state, the molecules are divided into positive ions and negative ions, the positive ions in the air are absorbed by the linear electrode 45, and the negative ions remain.

Electrons are more apt to concentrate on the linear electrode 45, which has the thin end (the small radius of curvature), and are more apt to produce a strong electric field, compared to an electrode that has a thick end. Therefore, the use of the linear electrode 45 generates negative ions even with the application of a low voltage.

Figure 12:
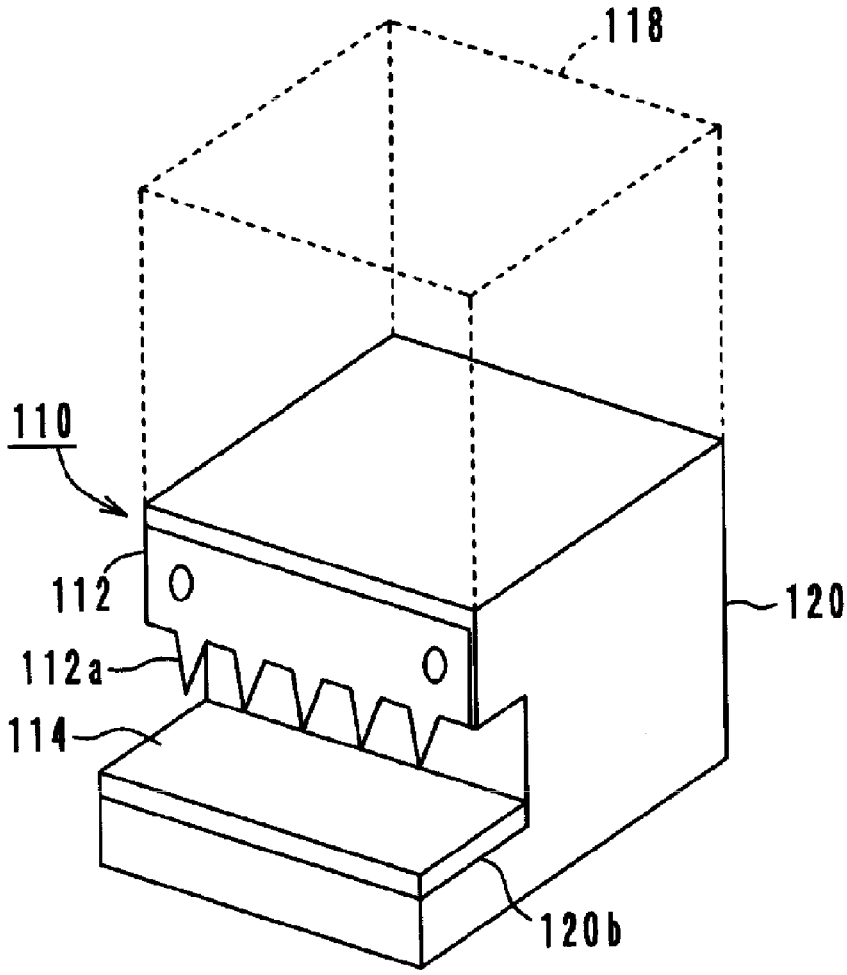
FIG. 12 is an external perspective view of a known ion generating apparatus.

Table 1 shows the results of measurements of the amount of generated negative ions when a voltage applied to the linear electrode 45 was changed. For the measurements, a well-known Ebert ion counter was used. The measurements were performed at a distance of about 30 cm from the ion generating apparatus 1 to the leeward side. The wind velocity was about 2.0 m/s. For comparison, Table 1 also shows the results of measurements of the amount of generated negative ions for the ion generating apparatus 110, as illustrated in FIG. 12, with the difference that a single sawtooth 112*a* is provided.

TABLE 1

| Applied Voltage (kV) | Comparative Example | Embodiment |
|---|---|---|
| −1.50 | 0.1 or less | 10-50 |
| −1.75 | 0.1 or less | 50-95 |
| −2.00 | 0.1 or less | 60-120 |
| −2.25 | 0.1 or less | 120 or more |
| −2.50 | 0.1 or less | 120 or more |
| −2.75 | 0.1 or less | 120 or more |
| −3.00 | 0.1 or less | 120 or more |
| −3.25 | 0.1 or less | 120 or more |
| −3.50 | 10-20 | 120 or more |
| −3.75 | 60-100 | 120 or more |

(Unit: $\times 10^4$/cc)

Table 1 shows that the ion generating apparatus 1 according to this preferred embodiment generates a sufficient amount of negative ions even with low voltages.

The sawtooth 112*a* of the known ion generating apparatus 110, as illustrated in FIG. 12, has a pencil shape in which a tip is sharpened. Therefore, when the sawtooth 112*a* is used, the tip becomes dull over time. As in the case in which a pencil point is reduced and rounded, the radius of curvature is gradually increased. As a result, the amount of generated ions reduces with an increase in the radius of curvature.

In contrast, because the linear electrode 45 according to this preferred embodiment has a fixed diameter, the radius of curvature does not change over time. As a result, the amount of generated ions is stable.

Figure 7:
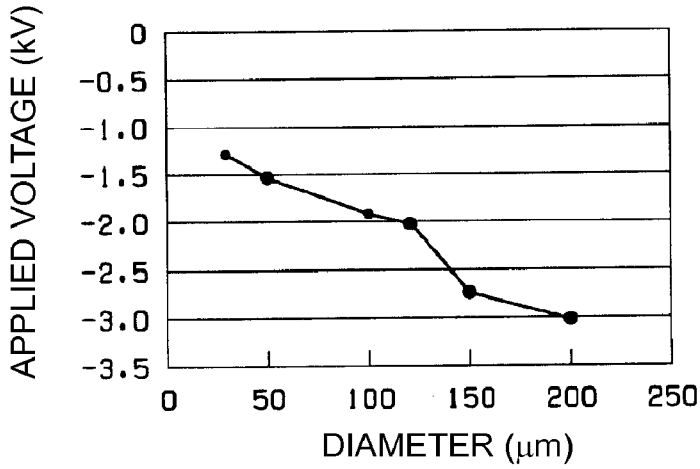
FIG. 7 is a graph showing a relationship between the applied voltage and the diameter of a linear electrode when the amount of generated ions is about 1,000,000/cc.

FIG. 7 is a graph showing a relationship between the applied voltage and the diameter of the linear electrode 45 when the amount of generated ions is about 1,000,000/cc. The measurements were performed at a distance of about 50 cm from the ion generating apparatus 1 to the leeward side. The wind velocity was about 3.0 m/s. The graph shows that, when the diameter of the linear electrode 45 is about 100 μm or less, a sufficient amount of negative ions is generated with a low applied voltage of about −2.0 kV.

In general, when ions are produced by a strong electric field, ions having the same polarity are electrically charged to a surrounding insulator. Since this surrounding charge has the same polarity as the strong electric field, they repel each other and the electric fields are weakened. Because the amount of generated ions is proportional to the electric field strength, the amount of generated ions decreases. That is, because a negative potential applied to the linear electrode 45 and a negative potential charged to the insulating casing have the same polarity, the amount of generated ions decreases.

Therefore, the ion generating apparatus 1 has a structure in which the insulating casing contact portion 42*d* of the ground electrode 42 is in direct contact with the substrate receiving base 36 (projection 36*a*) of the upper resin casing 3, and an electric charge (negative ion) to the insulating casing flows to ground via the ground electrode 42. As a result, an ion charge of the insulating casing decreases, a decrease in the electric field strength in the ion generating portion caused by the charge of the insulating casing is prevented, and a decrease in the amount of generated ions is prevented.

Covering the surface of the ground electrode 42 with the insulating film 44 suppresses the occurrence of ozone without substantially changing the amount of generated negative ions. In addition, since the insulating film 44 is arranged so as to cover substantially the entire surface of the insulating substrate 41 so that the high-voltage electrode 43, the contact portion 42*c*, and the insulating casing contact portion 42*d* of the ground electrode 42 remain uncovered, the gap between the high-voltage electrode 43 and the ground electrode 42 is covered with the insulating film 44, so that a short caused by condensation between the high-voltage electrode 43 and the ground electrode 42 is prevented.

Figure 8:
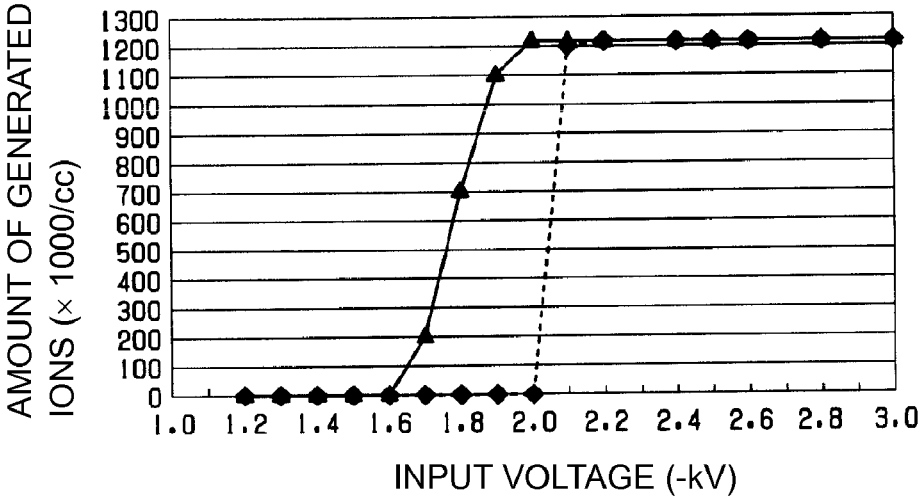
FIG. 8 is a graph showing a relationship between the amount of generated ions and the input voltage at a distance of about 50 cm from the ion generating apparatus.

FIG. 8 is a graph showing a relationship between the amount of generated ions and the input voltage at a distance of about 50 cm from the ion generating apparatus 1 to the leeward side (see the solid line). The wind velocity was about 2-3 m/s, and the upper limit of measurements of the ion counter was about 1,230,000/cc. For comparison, the graph also shows the measurements of the amount of generated ions for an ion generating apparatus that has the same structure as the ion generating apparatus 1 illustrated in FIG. 1, except that the ground electrode 42 is not connected to the insulating casing (see the dotted line). The graph shows that connecting the ground electrode 42 to the insulating casing reduces the voltage for generating ions. The graph also shows that the voltage that reached the measurement limit is lower as compared to when the ground electrode 42 is not connected to the insulating casing.

Figure 9:
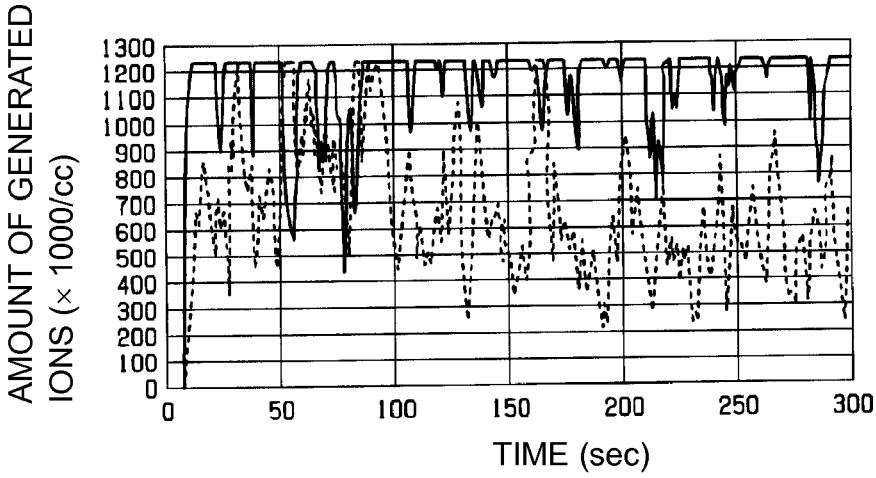
FIG. 9 is a graph showing the amount of generated ions at a distance of about 50 cm from the ion generating apparatus.

FIG. 9 is a graph showing the amount of generated ions at a distance of about 50 cm from the ion generating apparatus 1 when the input voltage is fixed at about −2.5 kV (see the solid line). For comparison, the graph also shows the results of measurements of the amount of generated ions for an ion generating apparatus that has the same structure as the ion generating apparatus 1 illustrated in FIG. 1, except that the ground electrode 42 is not connected to the insulating casing (see the dotted line). The graph shows that connecting the ground electrode 42 to the insulating casing increases the amount of generated ions.

Figure 10A:
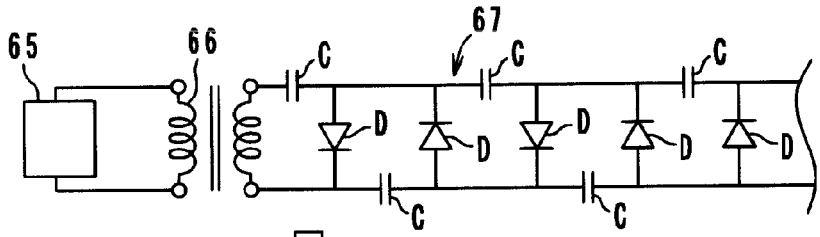
FIGS. 10A and 10B is an electric circuit diagram of a high-voltage power supply.
Figure 10B:
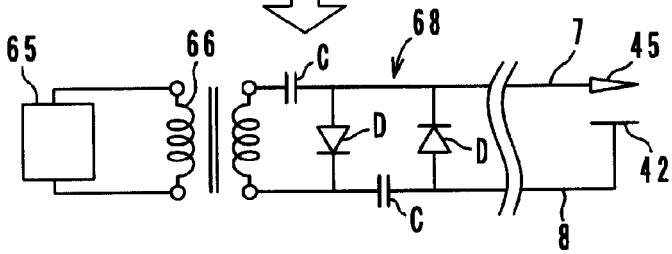

Because the voltage applied to the linear electrode 45 can be reduced, the cost of the high-voltage power supply is reduced. In general, when the absolute value of the output voltage is equal to or less than about 2.5 kV, an electric circuit and an insulating structure are simplified. For example, as illustrated in FIGS. 10A and 10B, a situation is discussed below in which an alternating-current voltage produced in an alternating-current circuit 65 is boosted by a transformer 66, and in addition, is raised in a Cockcroft circuit (a circuit of a combination of capacitors C and diodes D, the circuit performing rectification and multiplication). In this case, for the known ion generating apparatus, it is necessary to boost the voltage by about −1 kV to about −1.5 kV with the transformer 66 and then to multiply the voltage by a factor of 5, i.e., to boost it by about −5 kV to about −7.5 kV, with a Cockcroft circuit 67 as illustrated in FIG. 10A. In contrast, for the ion generating apparatus 1 according to this preferred embodiment, the voltage only need to be multiplied by a factor of 2 with a Cockcroft circuit 68 as illustrated in FIG. 10B, i.e., to boost it by about −2 kV to about −3 kV. As a result, the number of capacitors C and that of diodes D in the Cockcroft circuit can be reduced, and the circuit can be simplified.

Because the applied voltage can be less than before, safety is improved. Because the linear electrode 45 and the insulating film 44 are constructed two-dimensionally on the insulating substrate 41, the occupied volume is reduced, and miniaturization is achieved.

Table 2 shows the results of measurements of the amount of generated ozone when the voltage applied to the linear electrode 45 was changed. The measurements were performed at a distance of about 5 mm from the ion generating apparatus 1.

The wind velocity was about 0 m/s. For comparison, Table 2 also shows the results of measurements of the amount of generated ozone for the known ion generating apparatus 110, as illustrated in FIG. 12, with the difference that a single sawtooth 112*a* is provided.

TABLE 2

| Applied Voltage (kV) | Comparative Example | Embodiment: No insulating film 44 | Embodiment: With the insulating film 44 |
|---|---|---|---|
| −2.5 | — | 0.01 or less | 0.01 or less |
| −3.0 | — | 4.0—5.0 | 0.01 or less |
| −3.5 | 0.01 or less | 5.0 or more | 0.01 or less |
| −4.0 | 0.01 or less | 5.0 or more | 0.01 or less |
| −4.5 | 0.8-1.0 | 5.0 or more | 0.01 or less |
| −5.0 | 2.2-2.5 | 5.0 or more | 0.01 or less |

(Unit: ppm)

Table 2 shows that the amount of generated ozone in the ion generating apparatus 1 according to this preferred embodiment when the ion generating apparatus 1 is used is significantly reduced. In addition, because the insulating film 44 covers the ground electrode 42, a discharge starting voltage between the ground electrode 42 and the linear electrode 45 is greater as compared to a case in which only air is provided therebetween. As a result, a dark current passing between the end of the linear electrode 45 and the ground electrode 42 (this is leakage current, not discharge) is suppressed. This reduces the amount of generated ozone proportional to the amount of current.

Covering the ground electrode 42 with the insulating film 44 can prevent malfunction, such as anomalous discharge between the ground electrode 42 and the linear electrode 45, even when the gap between the ground electrode 42 and the linear electrode 45 is reduced for miniaturization.

FIG. 11 is a plan view of another ion generating component 4A. A ground electrode 42 of the ion generating component 4A includes only one leg 42*a* substantially parallel to a linear electrode 45. An insulating film 44 does not cover substantially the entire surface of an insulating substrate 41 and covers only a ground electrode 42 and the adjacent areas so that a contact portion 42*c* remains uncovered. In the ion generating component 4A, the contact portion 42*c* is in direct contact with the upper resin casing 3 of an insulating casing.

The present invention is not limited to the preferred embodiments described above. Various modifications may be made without departing from the sprit or scope of the invention.

For example, the position of the insulating casing contact portion of the ground electrode is not limited to the position described in the preferred embodiments described above. The insulating casing contact portion may be disposed at any position as long as the position ensures withstand voltage to the linear electrode (high-voltage electrode). The number of linear electrodes in the ion generating component is not limited to one. Two or more linear electrodes may be provided. However, when two or more linear electrodes are provided, it is necessary to consider the spacing therebetween because, if the linear electrodes are too close to one another, the electric field distribution becomes disordered and the discharge efficiency decreases. The present invention can be applied to not only the generation of negative ions but also that of positive ions. In the case of the generation of positive ions, a high-voltage power supply for generating a positive voltage is used, and the positive voltage is applied to the high-voltage electrode.

As described above, the present invention is useful for an ion generating unit and an ion generating apparatus that are used in an ion generating circuit in, for example, an air cleaner, an air conditioner, and other suitable device. In particular, the present invention is highly advantageous in that negative ions or positive ions can be generated with the application of a low voltage.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An ion generating unit comprising:

an insulating substrate provided with a ground electrode, the insulating substrate being provided with an insulating film at a region except for a portion of the ground electrode so as to cover the ground electrode;

a linear electrode; and an insulating casing arranged to accommodate the insulating substrate and the linear electrode; wherein the linear electrode is mounted to the insulating substrate so that the linear electrode faces the ground electrode, and the portion of the ground electrode that is not covered by the insulating film is connected to the insulating casing.

2. The ion generating unit according to claim 1, wherein the linear electrode has a diameter of about 100 um or less.

3. The ion generating unit according to claim 1, wherein the linear electrode has a tensile strength of at least about 2500 $N/mm^2$.

4. The ion generating unit according to claim 1, wherein a high-voltage electrode having a contact portion is provided on the insulating substrate, the linear electrode is mounted to the high-voltage electrode, and the insulating film is disposed so as to cover substantially the entire surface of the insulating substrate so that the high-voltage electrode, a contact portion, and an insulating casing contact portion of the ground electrode remain uncovered.

5. The ion generating unit according to claim 1, wherein the ground electrode is disposed so as to be substantially parallel to a longitudinal direction of the linear electrode.

6. The ion generating unit according to claim 1, wherein the insulating substrate includes a side having a depression, an end of the linear electrode projects in the depression, and the ground electrode includes two legs extending substantially parallel to the linear electrode and being disposed on the insulating substrate so that the two legs are disposed on both sides of the depression and so that the linear electrode is disposed between the two legs.

7. The ion generating unit according to claim 1, wherein the insulating casing includes an upper casing and a lower casing, and the lower casing is provided with a protrusion substantially corresponding to the insulating casing contact portion of the ground electrode on the insulating substrate.

8. The ion generating unit according to claim 1, wherein the insulating casing includes an upper casing and a lower casing, and the upper casing is provided with a projection corresponding to the insulating casing contact portion of the ground electrode on the insulating substrate.

9. The ion generating unit according to claim 1, wherein the ground electrode includes a resistor.

10. The ion generating unit according to claim 4, further comprising a first terminal being in contact with and connected to the contact portion of the high-voltage electrode and having a retaining portion for a lead, and a second terminal being in contact with and connected to the contact portion of the ground electrode and having a retaining portion for a lead, wherein the first terminal and the second terminal are accommodated in the insulating casing.

11. An ion generating apparatus comprising:

the ion generating unit according to claim 1; and a high-voltage power supply arranged to generate a negative voltage or a positive voltage.

12. An ion generating apparatus comprising:

a lead retained by each of the first terminal and the second terminal;

a high-voltage power supply arranged to generate one of a negative voltage and a positive voltage; and the ion generating unit according to claim 10.

13. The ion generating apparatus according to claim 11, wherein an absolute value of an output voltage from the high-voltage power supply is equal to or less than about 2.5 kV.

14. The ion generating apparatus according to claim 12, wherein an absolute value of an output voltage from the high-voltage power supply is equal to or less than about 2.5 kV.

* * * * *

UNITED STATES PATENT AND TRADEMARK OFFICE

CERTIFICATE OF CORRECTION

PATENT NO. : 7,636,229 B2
APPLICATION NO. : 11/566273
DATED : December 22, 2009
INVENTOR(S) : Kato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this

Ninth Day of November, 2010

David J. Kappos

David J. Kappos
*Director of the United States Patent and Trademark Office*